US011605908B2

(12) United States Patent
Tseng

(10) Patent No.: US 11,605,908 B2
(45) Date of Patent: Mar. 14, 2023

(54) CAM-TYPE WIRE CONNECTOR

(71) Applicant: HEAVY POWER CO., LTD., New Taipei (TW)

(72) Inventor: Chieg-Li Tseng, New Taipei (TW)

(73) Assignee: HEAVY POWER CO., LTD., New Taipei (TW)

( * ) Notice: Subject to any disclaimer, the term of this patent is extended or adjusted under 35 U.S.C. 154(b) by 36 days.

(21) Appl. No.: 17/223,389

(22) Filed: Apr. 6, 2021

(65) Prior Publication Data

US 2022/0320758 A1 Oct. 6, 2022

(51) Int. Cl.
*H01R 4/48* (2006.01)

(52) U.S. Cl.
CPC ..... *H01R 4/4836* (2013.01); *H01R 4/489* (2013.01)

(58) Field of Classification Search
CPC ..... H01R 4/4836
See application file for complete search history.

(56) References Cited

FOREIGN PATENT DOCUMENTS

CN 104995799 B 11/2017

*Primary Examiner* — Ross N Gushi
(74) *Attorney, Agent, or Firm* — Rabin & Berdo, P.C.

(57) ABSTRACT

A cam-type wire connector includes a housing, a conductor, and a lever. The housing has a plurality of insertion holes; the conductor comprises a conductive member and a leaf spring, the leaf spring has a carrier plate and a wire clamping portion that is formed with a plurality of windows. Wherein an elastic member is formed with the wire clamping portion for blocking the window; the lever has an operating portion and a toggle portion for cooperating with the leaf spring, the operating portion is constructed with a cam to allow the lever to swing without a fixed axis. When the lever is changed from an initial position to an actuate position, the elastic member is moved away from the carrier plate and an insertion channel is formed for allowing the wire to enter the window. The insertion channel is located in the interval between the second positioning surface and the fixed surface.

8 Claims, 16 Drawing Sheets

CAM-TYPE WIRE CONNECTOR

FIELD OF THE INVENTION

The present invention relates to a wire connector and in particular to a wire connector in which the wire can be clamped or released by operating a lever thereon.

BACKGROUND OF THE INVENTION

In the current market, among electronic parts used to connect multiple wires, there is a kind of wire clip that releases or clamps wires by toggling a lever on them, for example, such a wire clip is disclosed in the China invention patent No. CN104995799B.

In the case, a manipulator is rotated against an insulating material housing on an imaginary axis by toggling the manipulator so that the manipulator is rotated in a clockwise direction through the support groove in the insulating material housing and the circularly curved section of a rotary support area on the manipulator in FIGS. 3 and 4 of the case, and in the process of rotation the manipulator section on a rotary support area drives the clamping edge of the clamping spring to change its state.

In this way, different areas of the surface of the rotary support area are used directly as manipulators to rotate the manipulator and drive the clamping spring. Therefore, the shape of the rotation support area shows that this type of wire clamp may rotate the manipulator in the released state as long as the manipulator is subjected to a force sufficient to make the manipulator resist the frictional force between the manipulator and the support groove, and it will maintain the angle after rotation. Therefore, after a number of unintentional collisions and rotation, and after the amplitude of rotation has accumulated to a specific angle, the spring will revert to the closed state from the released state due to the elasticity of the clamping spring, causing inconvenience in operation.

SUMMARY OF THE INVENTION

The main purpose of the present invention is to provide a wire connector that can hold or release a wire at a specific position by toggling an element thereon to allow multiple wires to be electrically connected to each other. In order to prevent a device from accidentally releasing or fixing the wire, a lever is used to open or close the wire clamp with a cam as a spindle and automatically return to the original position within a certain degree of rotation angle, preventing the lever from accidentally returning to the closed state due to the elastic member's elasticity.

The secondary purpose of the present invention is to provide a wire connector that provides a different feel during operation by matching the shape of the cam of the lever and the shape of the groove on the internal leaf spring so that the user know whether the lever is in the opening position of the wire connector by the feel of operating the lever, increasing the convenience of use.

The next purpose of the present invention is to provide a wire connector with at least two or more positioning designs so that the originally movable and swingable lever is positioned when the wire connector being inserted into the open position of the wire, and further prevent the user from misunderstanding that the lever has not been pushed into position and continuing to force the lever, resulting its breakage and can't be used properly.

To achieve the aforementioned purpose, a cam-type wire connector according to this invention is provided, comprising a housing, a conductor, and a plurality of levers. The housing is formed with a plurality of insertion holes along an insertion direction, and an accommodation space is formed inside the housing for communicating with the insertion holes, so that a plurality of wires are inserted into the accommodation space along the insertion holes respectively.

The conductor is mounted in the accommodation space of the housing and comprises a conductive member that a plurality of contacts adjacent to each other and a leaf spring pressing the wire against the conductive member. The leaf spring has a carrier plate connected to the conductive member and a wire clamping portion extending from the carrier plate to form a plurality of windows. A plurality of elastic members is formed with an end of the wire clamping portion that far away from the carrier plate for extending toward the carrier plate.

The lever is movably assembled to the housing. The lever has an operating portion that cooperates with the leaf spring and a holding portion that being hold by a user. The contour of the operating portion is formed as a cam so that can operation portion is capable of swinging with a non-fixed axial, and the elastic member is capable of deformed by the cam.

The elastic member blocks the window on the insertion direction when the lever is positioned in an initial position, and the elastic member is away from the window by the cam when the lever is positioned in an actuate position. The operating portion has a push-back edge that moves the elastic member and a touch edge that contacts the conductive member. The push-back edge has a fixed surface that contacts the elastic member in the activation position. The touch edge has an first positioning surface that contacts the conductive member in the initial position, an second positioning surface that contacts the conductive member in the actuate position, and a push-back surface between the first positioning surface and the second positioning surface. When the lever is changed from the initial position to the actuate position, the lever contacts the conductive member and pushes the elastic member at the same time so that the elastic member is far away from the carrier plate for forming an insertion channel that allows the wire to enter the window, and the insertion channel is located in the interval between the second positioning surface and the fixed surface.

In an embodiment, the elastic member has a depressed area for contacting the push-back edge in the activation position.

In more detail, the elastic member comprises a back-fold portion, an extension portion that attached to the back-fold portion and extending along the insertion direction, and a covering portion that attached at one end of the extension portion and extending toward the carrier plate for blocking the window in the insertion direction. The depressed area is formed on the extension portion through two segments that extend in different directions.

In one embodiment, a first positioning structure and a second positioning structure are structured between the conductive member and the lever, the first positioning structure is formed between the elastic member and the cam, and the second positioning structure is formed between the lever and one of the conductive member or the carrier plate.

As can be seen from the above, in one embodiment, one of the conductive member or the carrier plate extends a push-back block to form the second positioning structure, the push-back notch has a first push-back surface that contacts the push-back block.

In one embodiment, the lever is restricted by the second positioning structure so that the lever can only swing for separating the push-back block.

Regarding the detailed shape of the cam, in one embodiment, the first positioning surface and the second positioning surface are formed as a horizontal surface, and the push-back surface is formed as a curve surface.

The touch edge contacts the conductive member and the housing simultaneously in the initial position. Further, a distance is formed between the fixed surface and the second positioning surface, and the distance is larger than the diameter of the wire.

From the above description, it can be seen that the characteristics of this invention are: the contact part between the lever and other members is a cam composed of a plane and an arc surface, and the lever can be moved in a straight line relative to the housing while swinging; during the movement that the lever moves relatively with the housing to the actuate position, the position of the contact point that the cam contacts the conductor can be continuously changed, and the contact method between the two affects the user's feeling when operating the unit; in addition, due to the shape of the cam, the lever will be positioned by the elastic member, the push-back block and the conductive member while in the actuate position, and a push-back block and a push-back notch are designed between the lever and the leaf spring to limit excessive rotation between them so that when the lever is in the actuate position, it remains stationary in the actuate position, and the cam-type wire connector comprises two types of positioning structures to prevent the lever changing from the initial state to the activation position; in this way, the lever is held in the actuate position and the leaf spring is kept in a deformed state to facilitate the wire penetration, and the leaf spring and the conductive member are both firmly clamped to the wire after the lever is returned to its original position.

DETAILED DESCRIPTION OF THE PREFERRED EMBODIMENTS

Figure 1:
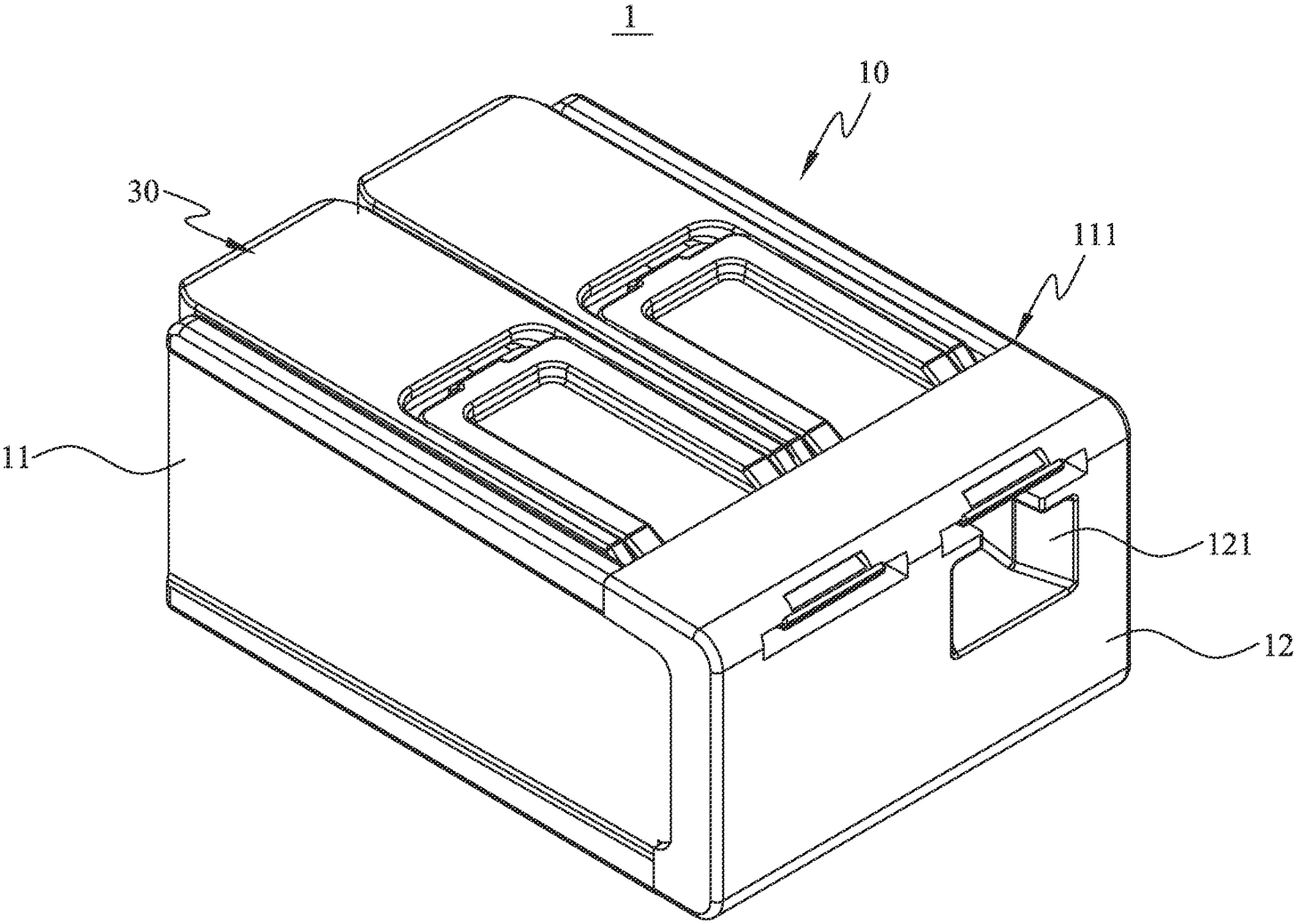
FIG. 1 shows a three-dimensional view of a cam-type wire connector of this invention in a first preferred embodiment.

Hereinafter, preferred embodiments of the present invention are cited, and further detailed description is given as follows in conjunction with the drawing.

With reference to FIG. 1, in a first preferred embodiment, a cam-type wire connector 1 of the present invention consists mainly of a housing 10, a conductor 20, and two levers 30. When the cam-type wire connector 1 is used, a wire can be plugged into the housing 10 along one direction. By changing the shape of the conductor 20 through operating the two levers 30, it is possible to clamp and electrically connect the two wires.

Figure 2:
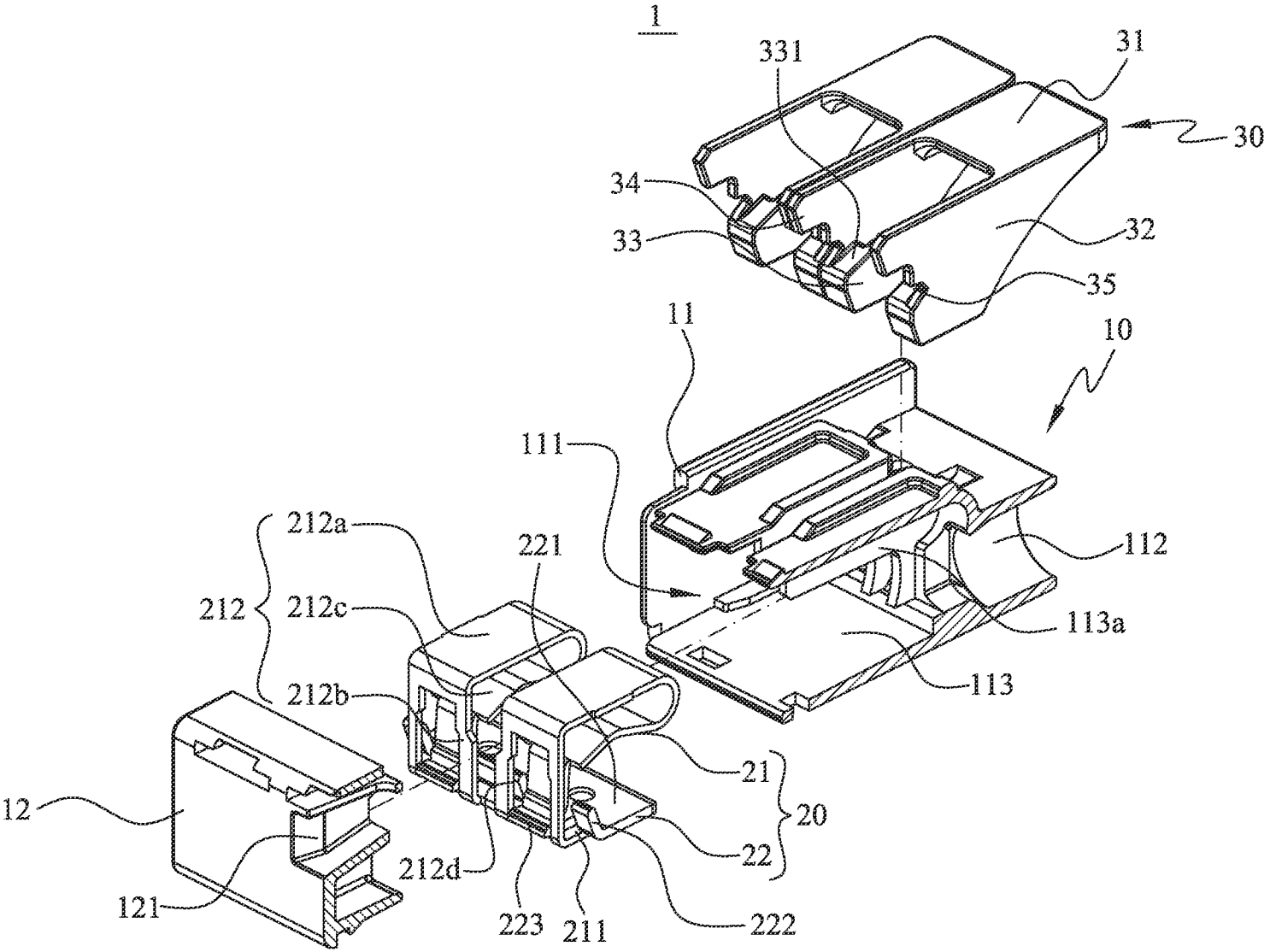
FIG. 2 shows an exploded view of the embodiment in FIG. 1.
Figure 3:
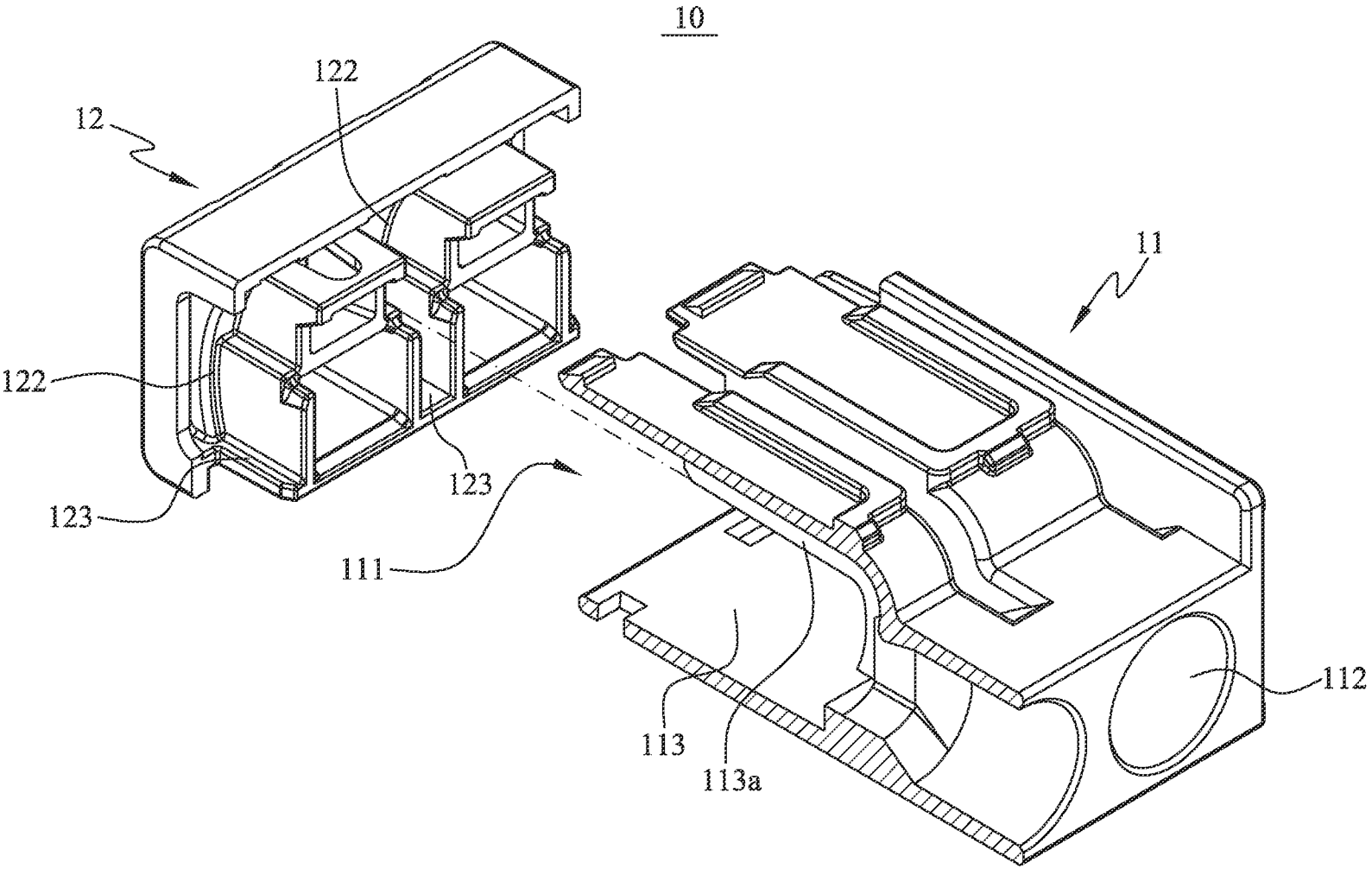
FIG. 3 shows a schematic view of a housing.

With reference to FIGS. 2 and 3, the housing 10 has an accommodated housing 11 in a hollow configuration and a cover 12 attached to the accommodated housing 11. The accommodated housing 11 is provided with an installation opening 111 on one side along the direction of wire insertion, and the accommodated housing 11 is provided with two installation holes 112 of different shapes from the installation opening 111 on one side away from the installation opening 111. The interior of the accommodated housing 11 is formed with a plurality of accommodation spaces 113 that separated by a spacing wall 113*a* (one accommodation space 113 that corresponds to one insertion hole 112) between the installation opening 111 and the insertion hole 112. The installation opening 111 is connected to each insertion hole 112 through the accommodation space 113. When assembled, the cover 12 is placed over the installation opening 111 in the direction of the insert.

As shown in the figure, in this embodiment, a detection channel 121 is formed through the cover 12 at a position corresponding to one of the insertion holes 112. When the cover 12 is assembled in the installation opening 111, a portion of the area of the installation opening 111 is aligned with the detection channel 121 so that the detection channel 121 is connected to the accommodation space 113 along the direction of the wire insertion.

Besides, the cover 12 has a plurality of guiding surface 122 with an arc pattern and a push-back surface 123 with a flat pattern on one side near the accommodated housing 11. When the cover 12 is assembled in the installation opening 111, the guiding surface 122 and the push-back surface 123 are both located inside the housing 10, and the guiding surface 122 is far away from the insertion hole 112 in the insertion direction.

Figure 4:
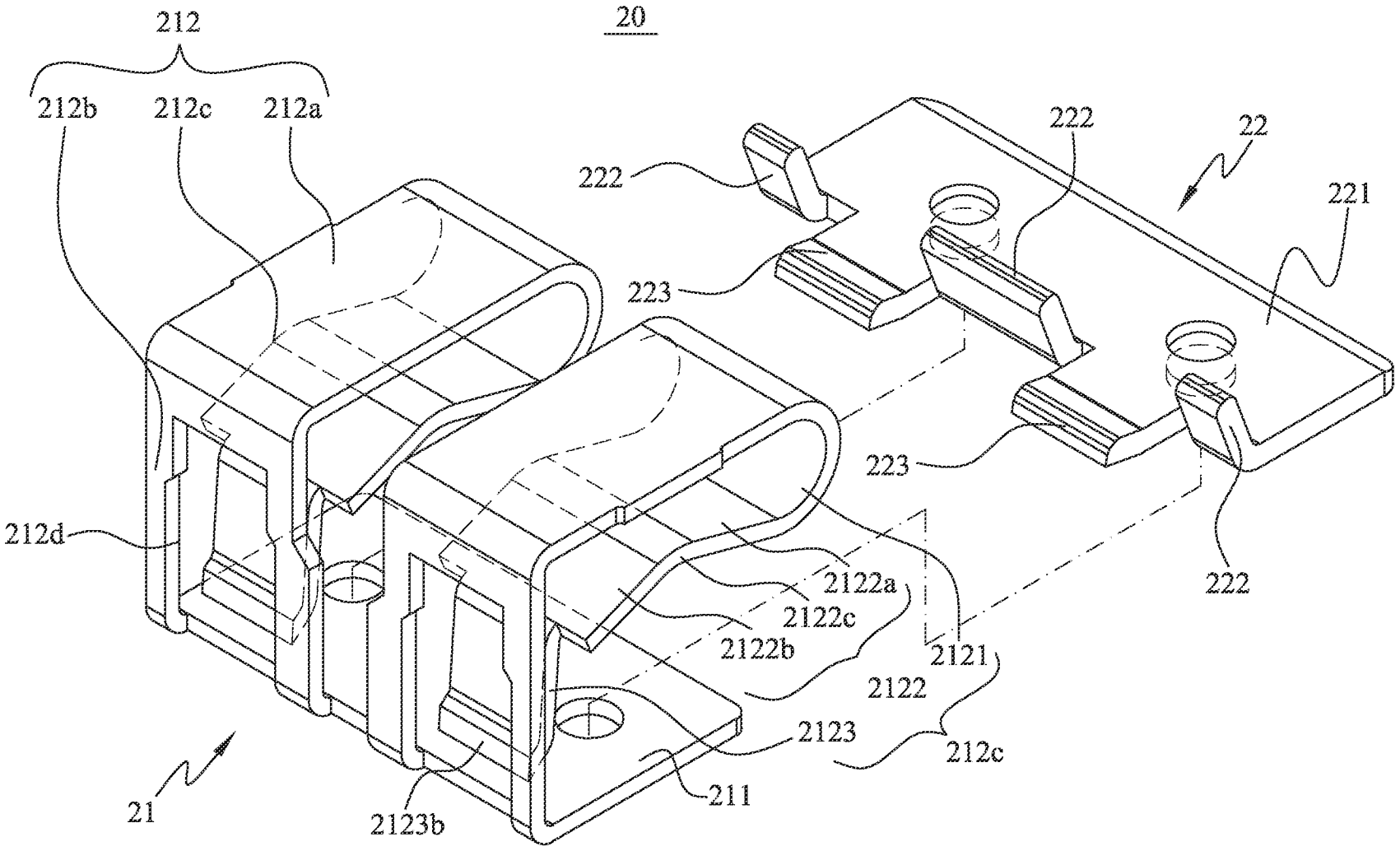
FIG. 4 shows an exploded view of a conductor.

With reference to FIG. 2 and FIG. 4, the conductor 20 is constructed of a metal material and capable of conducting electricity, comprising a leaf spring 21 and a conductive member 22. The leaf spring 21 is provided with a carrier plate 211 assembled to the conductive member 22 and two wire clamping portions 212 perpendicular to the carrier plate 211.

Each of the wire clamping portions 212 has a connecting section 212*a* parallel to the carrier plate 211 and a support section 212*b* connected to the connecting section 212*a* and the carrier plate 211. In this embodiment, the support section 212*b* is perpendicular to the connecting section 212*a*, and the connecting section 212*a* has a flexible section 212*c* capable of deforming into an elastic member by back-folding at an end distant from the support section 212*b* in a direction opposite to the direction of insertion. The flexible section 212*c* of each of the wire clamping portions 212 is positioned between the carrier plate 211 and the connecting section 212*a*.

In this embodiment, the flexible section 212*c* may be divided into a back-fold section 2121 attached to the connecting section 212*a*, an extension portion 2122 attached to the back-fold portion 2121 extending in the opposite direction of the wire insertion direction, and a covering portion 2123 extending from one end of the extension portion 2122 toward the carrier plate 211. The extension portion 2122 is formed by two segments (first segment 2122*a* and second segment 2122*b*) extending in different directions with a depressed area 2122*c* facing the opening of the carrier plate 211 as in FIG. 4.

The support section 212*b* of each of the wire clamping portions 212 penetrates along the wire insertion direction to form a window 212*d*. In this embodiment, the flexible section 212*c* as an elastic member is positioned against the window 212*d* and can block the window 212*d* in the direction of wire insertion, and its length can contact the conductive member 22 set on the carrier portion 211 when the wire clamping portion 212 is not subject to external force. In addition, in this embodiment, the width of the covering portion 2123 is smaller than of the width of the carrier plate 211 and the extension portion 2122, and a bending segment 2123*b* is formed near the end of the carrier plate 211 extending toward the window 212*d*, the bending segment 2123*b* can be deformed when the cam-type wire connector 1 clamps the wire.

As shown in the figure, in this embodiment, the conductive member 22 comprises a contact block 221 assembled on the carrier plate 211 for contacting the wires, three push-back blocks 222 extending outwardly from one end of the contact block 221 that are inclined to the contact block 221, and two guiding blocks 223 that are horizontal and slightly elevated away from the end of the contact block 221. The push-back block 222 and the guiding block 223 are staggered so that each guiding block 223 is positioned between the two push-back blocks 222. Each of the guiding blocks 223 is provided one on one through one of the windows 212*d*. In this embodiment, one of the wire clamping portions 212 is aligned with the detection channel 121 when the conductor 20 is assembled in the interior of accommodation space 113 of the housing 10. In this way, users may check the proper conductivity of the conductor 20 through the detection channel 121.

Figure 5:
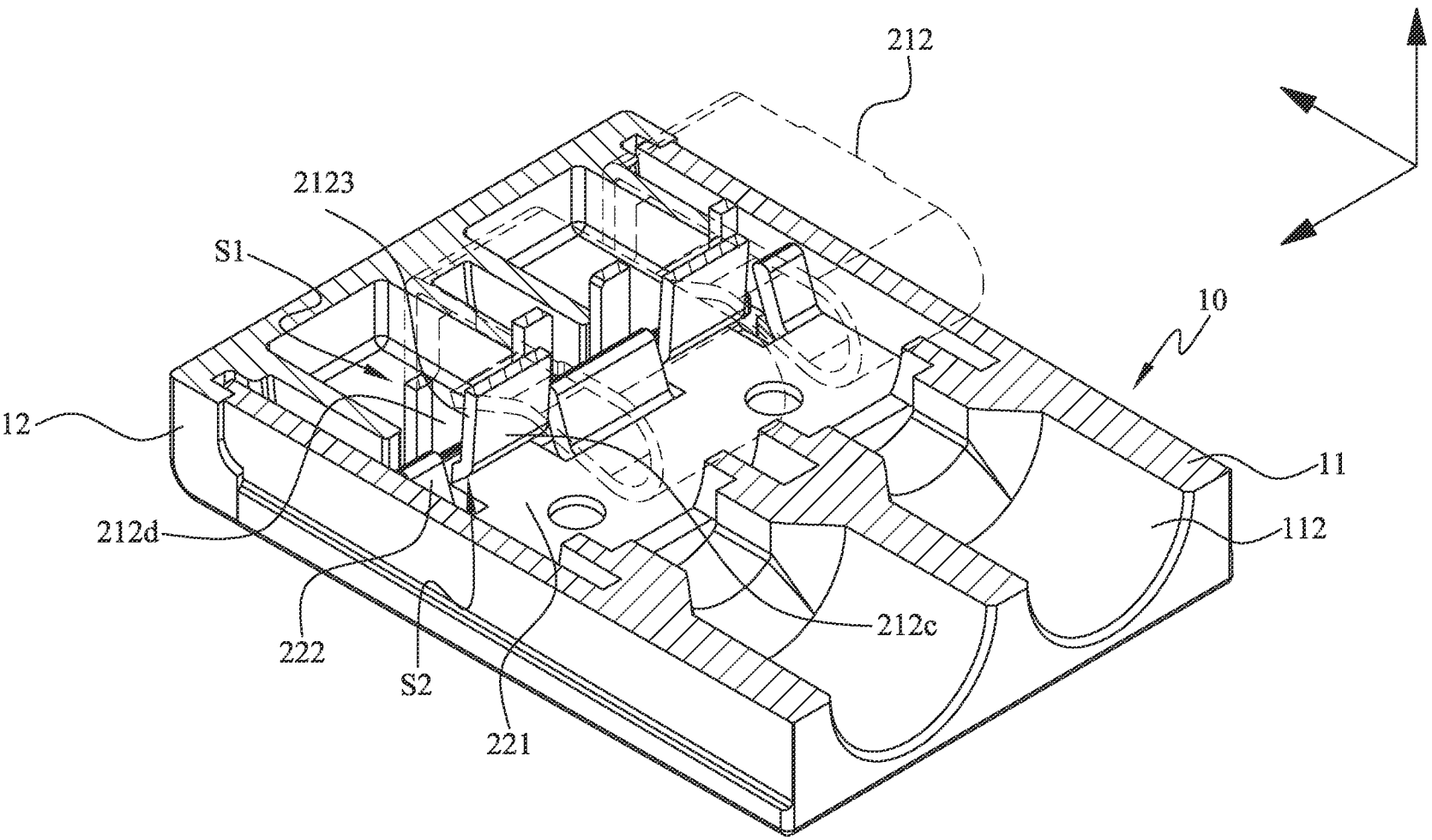
FIG. 5 shows a schematic view of an insertion hole, a window, and a flexible section arranged to present a first linear pattern.

As shown in FIG. 5, when being assembled, each of the wire clamping portions 212 will be simultaneously one to one aligned with the insertion holes 112 and window 212*d* of the housing 10. The insertion hole 112, the window 212*d*, and the flexible section 212*c* are sequentially arranged in a straight line to present a first linear pattern S1 parallel to the X-axis (as shown in FIG. 5). Further, in this embodiment, each flexible section 212*c* is positioned one on one above one of the guiding blocks 223 so that a portion of each flexible section 212*c* may be positioned between each of the two push-back blocks 222, and the plurality of push-back blocks 222 and the plurality of flexible sections 212*c* are aligned to form a second vertical pattern S2 perpendicular to the first linear pattern S1 arrangement (parallel to the Y-axis).

In this embodiment, the lever 30 has a holding portion 31 at one end which serves as a grip for the user and a connecting arm 32 on each of the opposite sides of the short axis of the holding portion 31 for acting with the leaf spring 21. In the detailed configuration, each connecting arm 32 extends in the direction of the other connecting arm 32 and is constructed with a cam 33 between the two connecting arms 32. A snap-in groove 321 corresponding to the thickness of the spacing wall 113*a* is also constructed between the cam 33 and the connecting arm 32. Each connecting arm 32 is provided with a stopper 34 in the direction from the holding portion 31 toward the cam 33 and a push-back notch 35 in the direction from the holding portion 31 toward the cam 33. And the stopper 34 is spaced in the push-back notch 35.

In this embodiment, the stopper 34 is formed by extending outward from the connecting arm 32. The stopper 34 has a flat stopping surface 341 far away from one side of the connecting arm 32 and an push-back surface 342 adjacent to the stopping surface 341 but with a different surface orientation. The push-back notch 35 is provided with a push-back end surface 351 on opposite sides and a push-back opening 352 spaced apart on the push-back end surface 351. A first push-back surface 353 is provided on one side of the push-back end surface 351 near the cam 33, and a second push-back surface 354 is provided on one side away from the first push-back surface 353 and away from the cam 33. The first and second push-back surfaces 353 and 354 are separated by a distance H. The distance of the separation distance H is greater than the thickness of the push-back block 222.

Figure 6A:
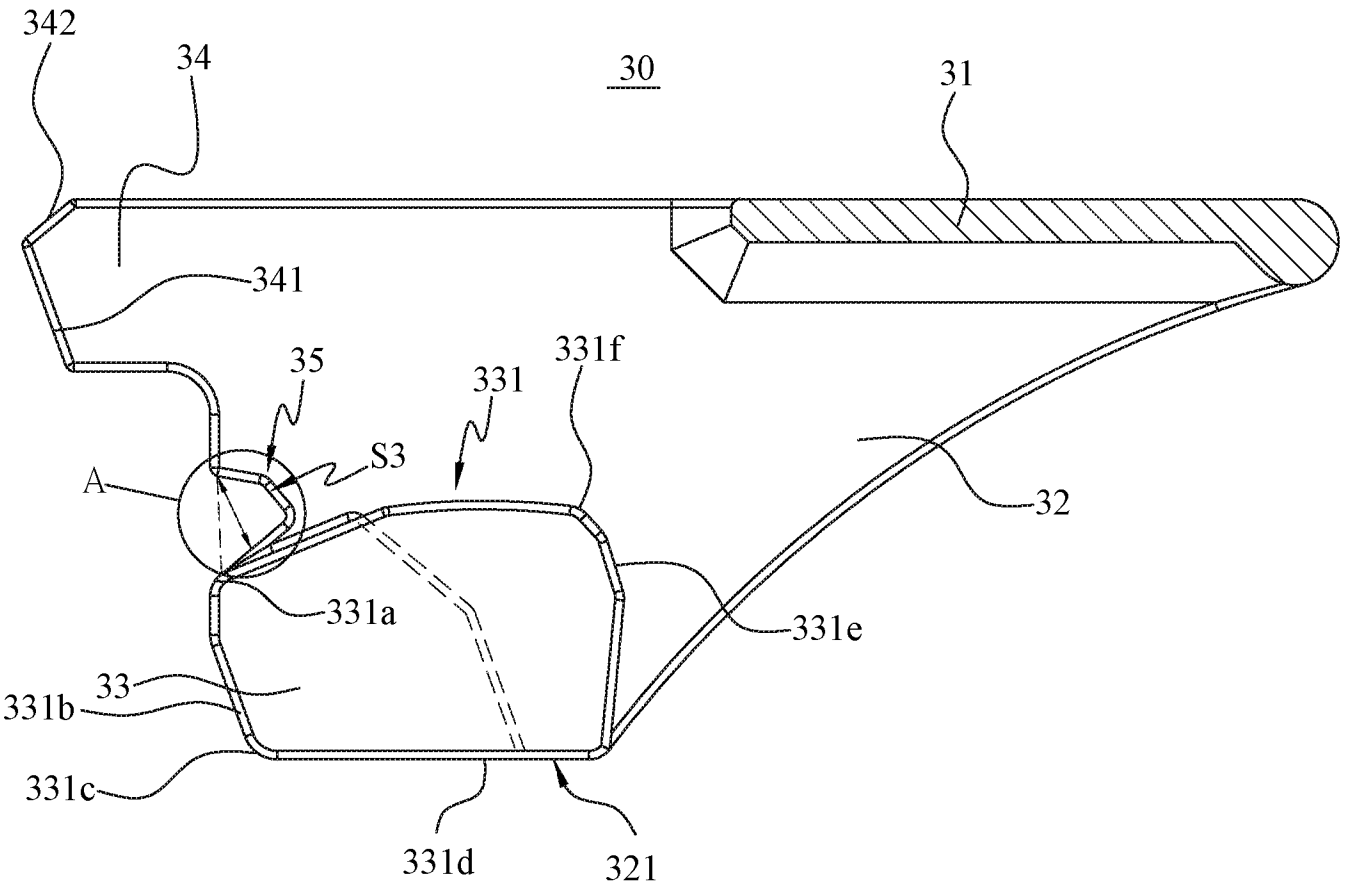
FIG. 6A shows a side view of a lever.
Figure 6B:
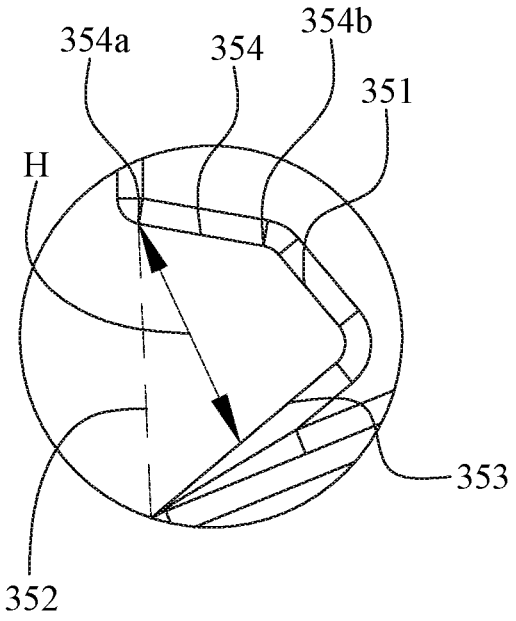
FIG. 6B is an enlarged view of part A in FIG. 6A.

As shown in FIG. 6A and FIG. 6B, the second push-back surface 354 is provided with a top end 354*a* near the push-back opening 352 and the push-back opening 352 is provided with a bottom end 354*b* near the push-back end surface 351. In this embodiment, since the top end 354*a* is further away from the first push-back surface 353 than the bottom end 354*b* and the second push-back surface 354 and the first snap surface 353 are not parallel to each other, the distance between the top end 354*a* and the bottom end 354*b* is different from the second push-back surface 354 respectively. In this way, when the push-back notch 35 is extended from the push-back opening 352 toward the push-back end surface 351 by the second push-back surface 354, the second push-back surface 354 will gradually approach the first push-back surface 353 so that the push-back notch 35 exhibits a tapering pattern S3 from the push-back opening 352 toward the push-back end surface 351.

Regarding the shape of the cam 33, please refer to FIG. 6A and 6B. The outer periphery of the cam 33 is formed with an actuating profile 331, which has a first push-back surface 331*a*, a second positioning surface 331*b*, a second push-back surface 331*c*, a first positioning surface 331*d*, a fixed surface 331*e*, and a touch surface 331*f* in counterclockwise order along the profile of the cam 33 in the figure. The first push-back surface 331*a* is used to contact the push-back block 222 to activate the second positioning surface 331*b* on the long axis of the cam 33 near the side of the push-back notch 35 of the lever 30, which is described in detail later, and is located between the first and second push-back surfaces 331*a* and 331*c*.

As shown in the figure, in this embodiment, the first and second push-back surfaces 331*a* and 331*c* and the touch surface 311*f* exhibit curved surfaces, and the second positioning surface 331*b* exhibits a flat pattern and is located between the push-back notch 35 and the first positioning surface 331*d*. The first positioning surface 331*d* and the fixed surface 331*e* also appear to be flat. The first positioning surface 331*d* intersects the second positioning surface 331*b* and is not parallel to the second positioning surface 331*b*. In addition, the fixed surface 331*e* is provided on the side of the cam 33 on its long axis away from the push-back notch 35 so that the second positioning surface 331*b* and the fixed surface 331*e* are both located on opposite sides of the cam 33. In this embodiment, the second positioning surface 331*b* and the fixed surface 331*e* are also substantially parallel to each other. Further, the touch surface 331*f* is provided on the side of the cam 33 on the short axis away from the first positioning surface 331*d*, and is located on opposite sides of the cam 33, respectively. Also, the touch surface 331*f* is located between the first push-back surface 331*a* and the fixed surface 331*e*. And as can be seen from the figure, the shortest distance between the touch surface 331*f* and the first positioning surface 331*d* is smaller than the shortest distance between the fixed surface 331*e* and the second positioning surface 331*b*.

Figure 7:
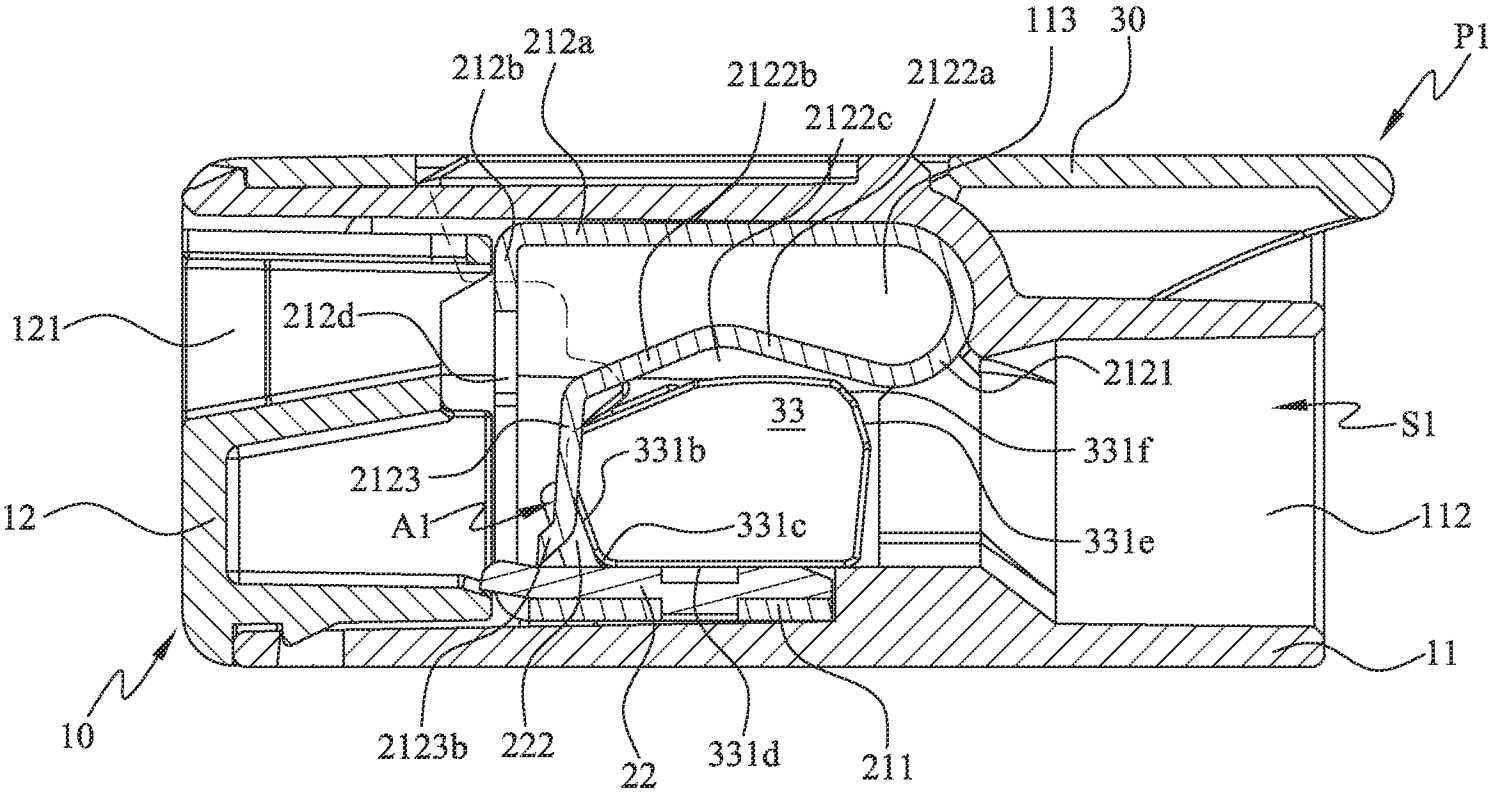
FIG. 7 shows a schematic view of the lever in the initial position.

With reference to FIG. 7, each lever 30 is movably assembled in the housing 10 when the members are assembled. Due to the size of the cam 33, the lever 30 and the housing 10 may swing and move relative to each other for non-fixed axial swinging. The holding portion 31 of the lever 30 is located outside the accommodation space 113 of the housing 10, while each of the cams 33 is located inside the accommodation space 113. Each cam 33 is positioned between the conductive member 22 and the extension portion 2122 of the leaf spring 21. The fixed surface 331*e* and the touch surface 331*f* of the cam 33 form the push-back edge of the lever 30 capable of driving the flexible section 212*c* when swinging during assembly. The second positioning surface 331*b*, the second push-back surface 331*c*, and the first positioning surface 331*d* of the cam 33 form the touch edge of the lever 30 contacting the conductive member 22 during swinging.

With reference to FIG. 7, when the lever 30 is in the initial position P1, the first positioning surface 331*d* of the cam 33 is able to contact the contact block 221 of the conductive member 22. And the second positioning surface 331*b* faces the push-back block 222 of the conductive member 22. In this embodiment, in the initial position P1, the cam 33 does not touch the flexible section 212*c* of the leaf spring 21 so that the flexible section 212*c* is in an initial state A1 without deformation. In this case, the covering portion 2123 blocks the window 212*d* in the insertion direction so that the wire cannot enter the window 212*d*.

As shown in FIG. 7, in this embodiment, when the lever 30 is in the initial position P1, the lever 30 can move laterally in a straight line relative to the housing 10 so that the lever 30 may move either towards the push-back block 222 or towards the insertion hole 112 of the housing 10.

Figure 8A:
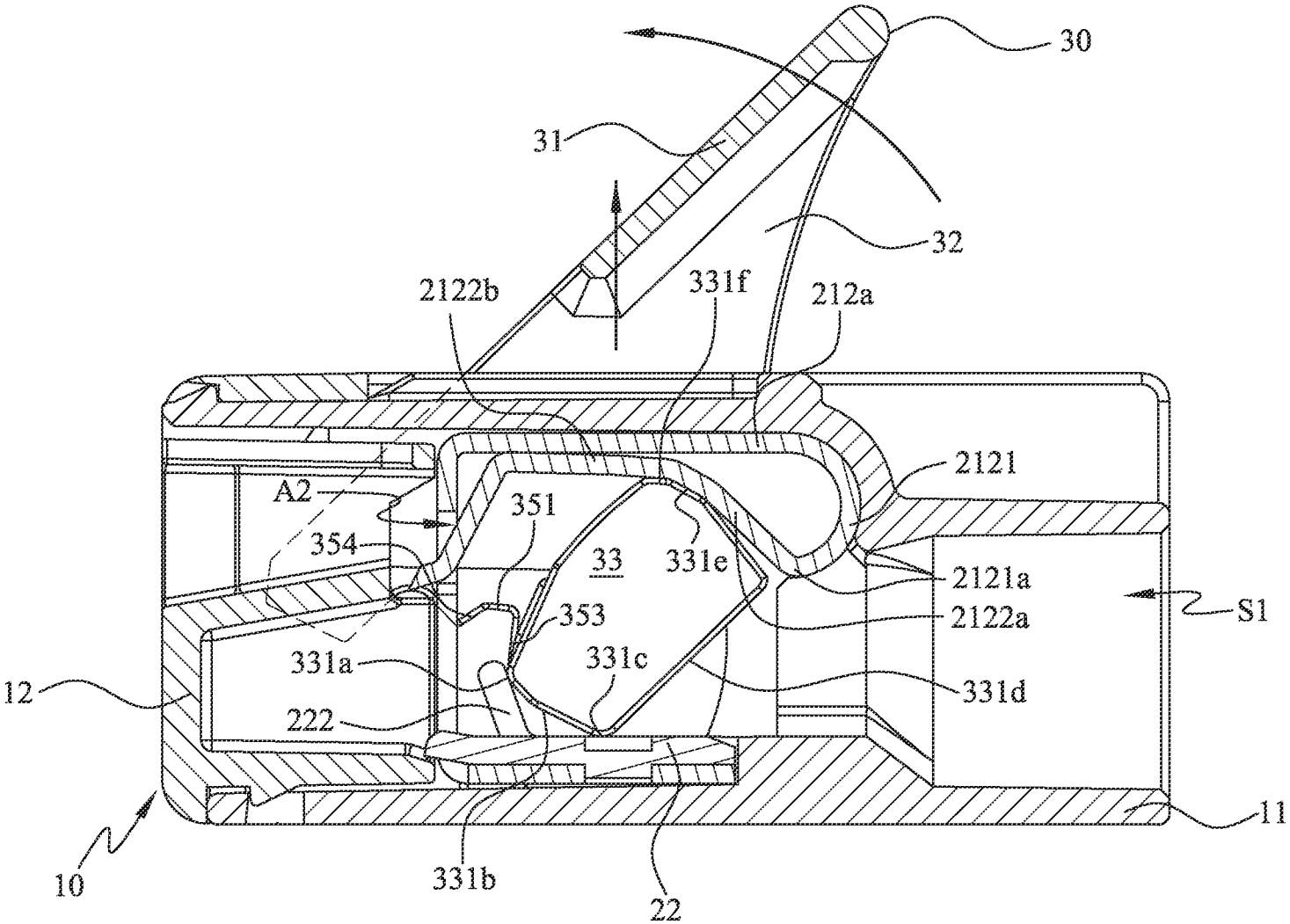
FIG. 8A shows a schematic view of the lever moving from the initial position to the actuate position.

With reference to FIG. 8A, when the lever 30 swing away from the initial position P1 against the housing 10 in the direction of the arrow in the figure, the cam 33 will swing against the accommodated housing 11 of the housing 10, the touch surface 331*f* will contact and push against the flexible section 212*c*, and the first positioning surface 331*d* will be separated from the contact block 221 and contact the block with the second push-back surface 331*c*.

As shown in the figure, when the first and second push-back surfaces 331*a* and 331*c* of the cam 33 are in contact with the push-back block 222 and the contact block 221, respectively and the first positioning surface 331*d* and the fixed surface 331*e* of the actuating profile 331 are not in contact with the conductor 20, the touch surface 331*f* of the actuating profile 331 will be able to contact and push on the flexible section 212*c* of the wire clamping portion 212, causing the flexible section 212*c* to deform toward the connecting section 212*a* of the wire clamping portion 212 so that the flexible section 212*c* changes from the initial state A1 to a deformed state A2 in which the deformation occurs.

As shown in the figure, the position of the joint 2121*a* between the back-fold section 2121 and the extension portion 2122 of the flexible section 212*c* is located to the right of the touch surface 311*f* in the horizontal direction (the direction in the figure) when the lever 30 is in the initial position P1, and the first segment 2122*a* of the extension portion 2122 extends in the direction away from the carrier plate 211 so that when the cam 30 swings, the first segment 2122*a* will form an inclined surface extending in the direction of the left side of the figure in either the initial state A1 or the deformed state A2. The contact between the touch surface 331*f* and the flexible section 212*c* is formed first on the first segment 2122*a* and keeps the covering portion 2123 away from the conductive member 22. Therefore, when the cam 33 swings and contacts the first segment 2122*a*, the cam 33 will be guided by the force provided by the first segment 2122*a* to slide to the left and not to the right. With the above description, when the cam 33 swings, the second push-back surface 331*c* of the cam 33 will be able to slide and rotate counterclockwise against the conductive member 22 toward the right side, allowing the first push-back surface 331*a* to contact the push-back block 222.

Afterwards, the first push-back surface 331*a* will contact the push-back block 222 of the conductor 20 with the movement of the cam 33 (in some embodiments, the push-back block 222 may be deformed by the squeezing of the cam 33). At the same time, the action cam 33 changes the position of the area where the actuating profile 331 contacts the conductor 20 so that the surface of the cam 33 contacting the contact block 221 will change from the first positioning surface 331*d* to the second push-back surface 331*c*. In this way, as the lever 30 is swinging, the lever 30 changes from a state where it is not acted upon by the flexible section 212*c* to a state where it is pushed against by the flexible section 212*c*. And when the rotation stroke of the lever 30 to the end (FIG. 9A), the resistance provided by the elastic member will be directly transmitted to the conductive member 22 by the shape design of the cam 30, and may produce a difference in the user's operating feel (resistance).

Also, as shown in FIG. 8A, in this embodiment, due to the angle between the first segment 2122*a* and the second segment 2122*b* and the length of the second segment 2122*b*, the second segment 2122*b* will be driven by the first segment 2122*a* to approach the connecting section 212*a* during the swinging of the cam 33, and the covering portion 2123 is then driven away from the conductive member 22 by the second segment 2122*b*.

Figure 8B:
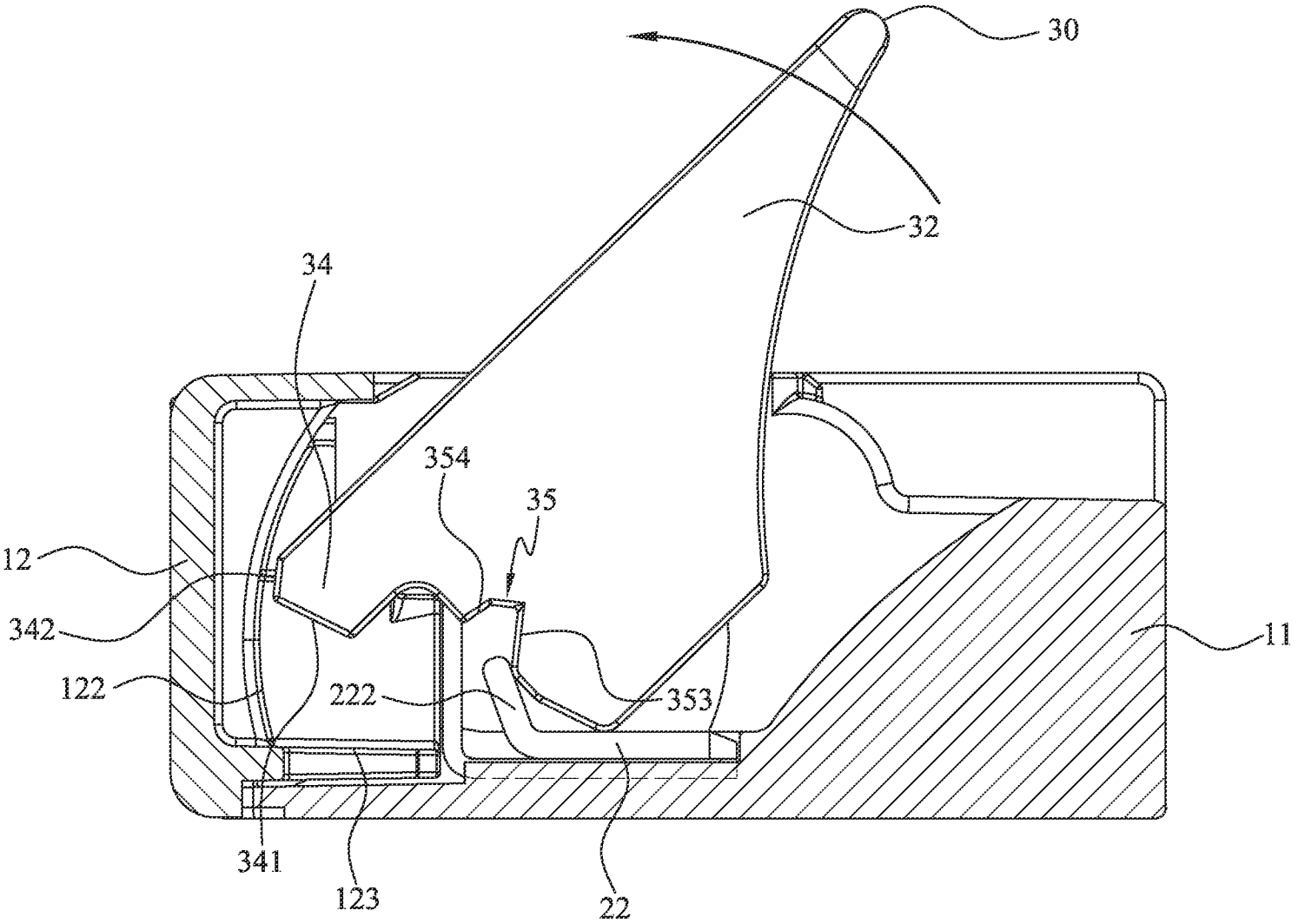
FIG. 8B shows a schematic view of the lever without touching the guiding surface.
Figure 8C:
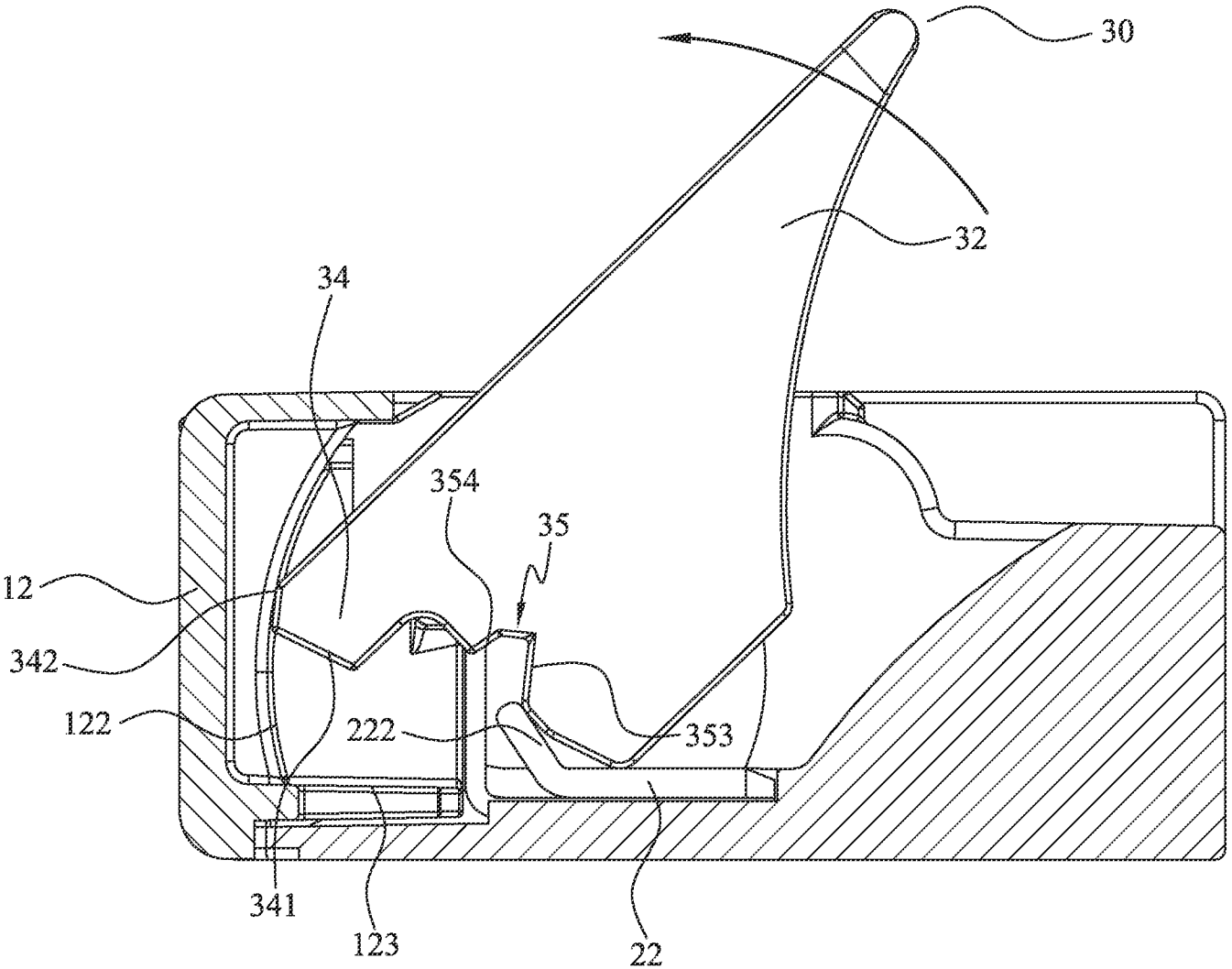
FIG. 8C shows a schematic view of the lever touching the guiding surface in another embodiment.

With reference to FIG. 8B, in this embodiment, in the process of moving the lever 30 away from the initial position P1, the push-back surface 342 of the lever 30 will maintain a certain spacing from the guiding surface 122 of the housing 10 so that the push-back surface 342 will not touch the guiding surface 122. However, the push-back surface 342 does not contact the guiding surface 122 for illustrative purposes only. In another embodiment, as shown in FIG. 8C, during the swinging of the lever 30 relative to the housing 10, the push-back surface 342 contacts the guiding surface 122 so that the stopping surface 341 of the lever 30 may indeed gradually approach the push-back surface 123 of the cover 12.

Figure 9A:
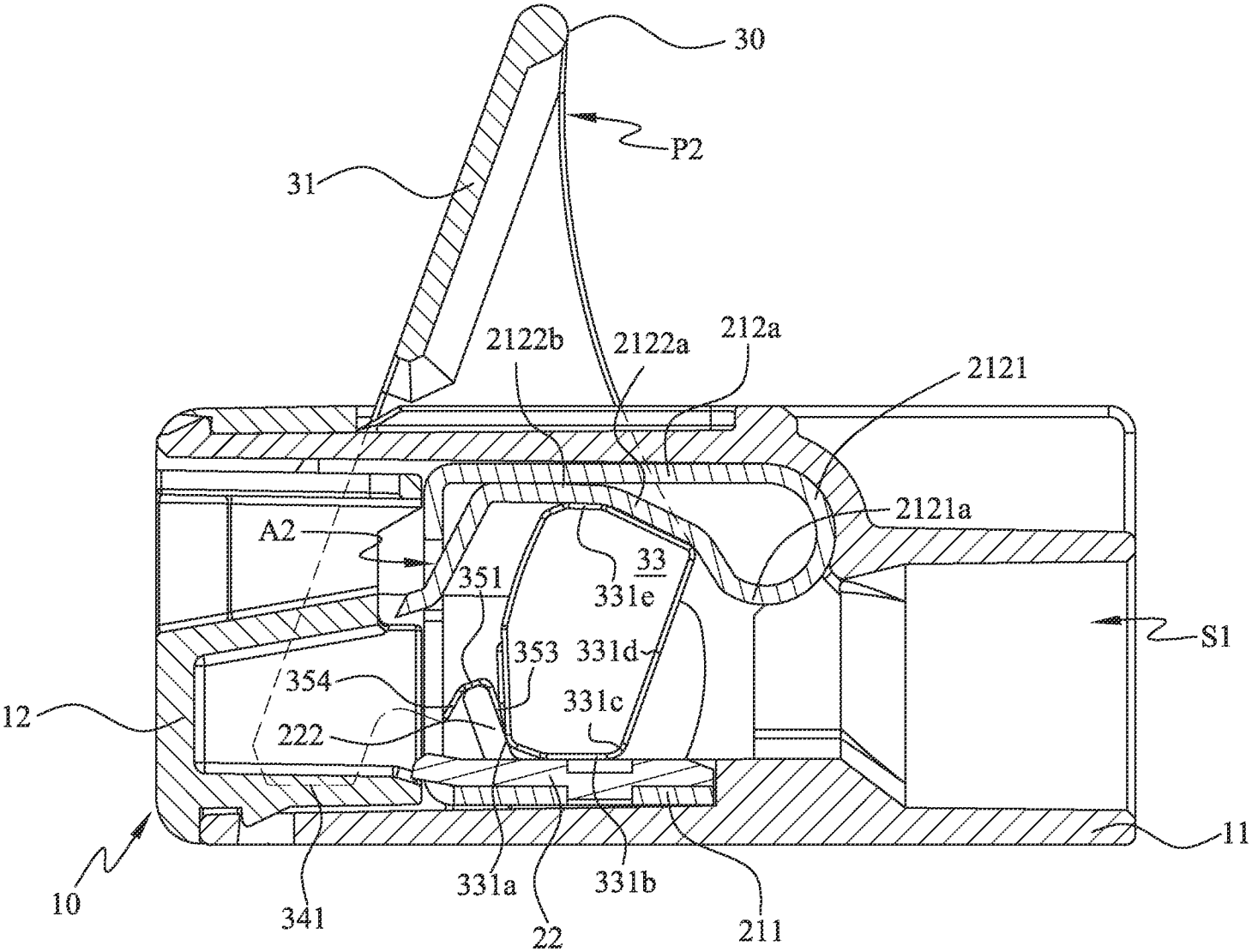
FIG. 9A shows a schematic view of the lever in the actuate position.
Figure 9B:
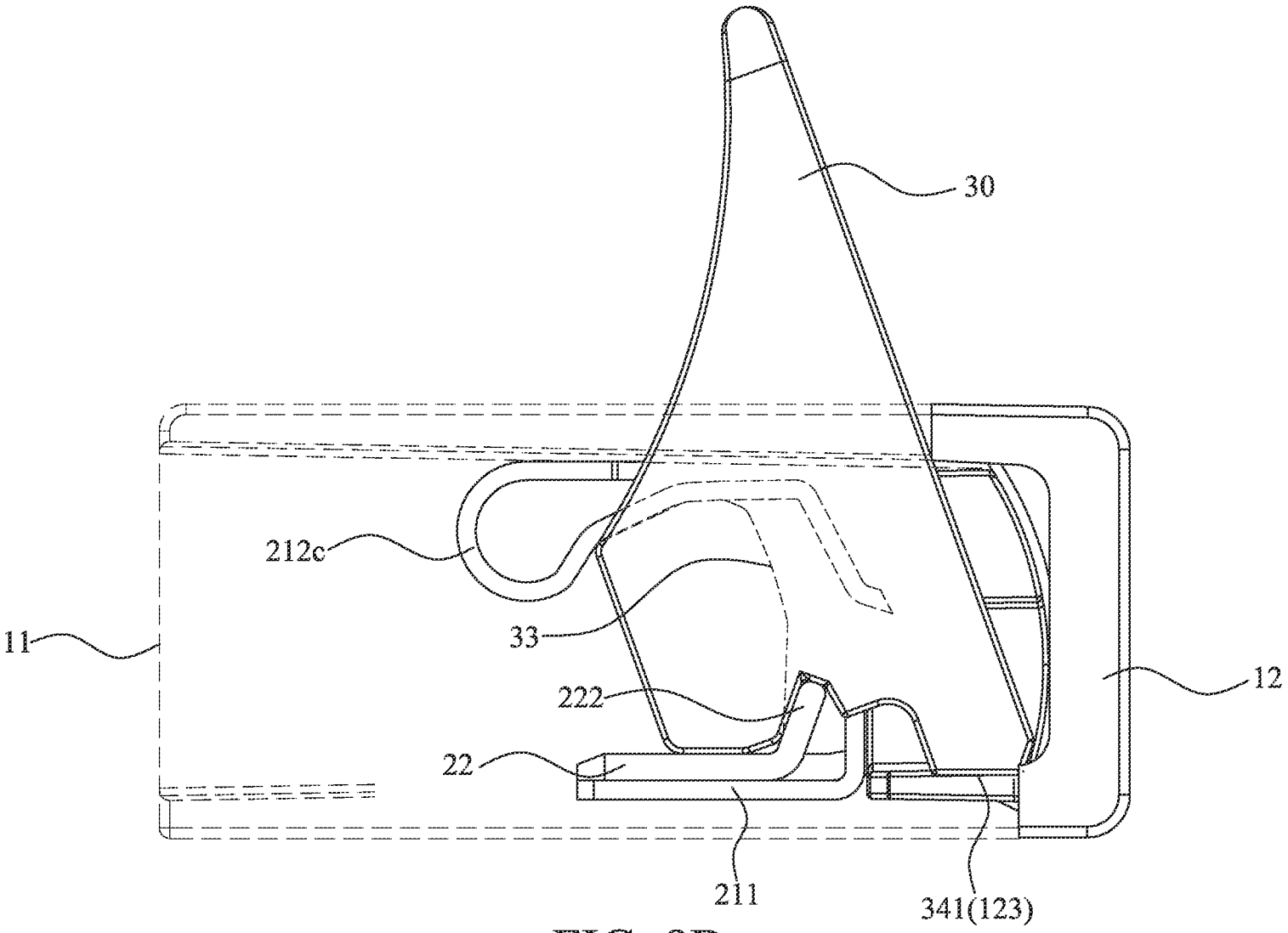
FIG. 9B shows a schematic view of a stopping surface touching a cover.

With reference to FIG. 9A and FIG. 9B, when the lever 30 continues to swing against the housing 10 and thus the first push-back surface 331*a* of the cam 33 is made to remain close to the contact block 221 of the conductive member 22, the cam 33 continues to push against the flexible section 212*c* of the leaf spring 21 so that the covering portion 2123 of the flexible section 212*c* is closer to the connecting section 212*a* and farther away from the conductive member 22.

When the lever 30 continues to swing to make the stopping surface 341 of the connecting arm 32 contacts the push-back surface 123 of the cover 12, because the push-back notch 35 exhibits a tapering pattern S3, the push-back block 222 of the conductive member 22 is made to easily enter the push-back notch 35 of the lever 30. When the push-back block 222 is positioned inside the push-back notch 35, the first push-back surface 353 of the push-back notch 35 and the push-back end surface 351 of the push-back notch 35 are in contact with different sides of the push-back block 222, and the first push-back surface 353 will be able to make face-to-face contact with the surface of the push-back block 222, thereby allowing the lever 30 to stop swinging relative to the housing 10 (i.e., in some embodiments where the length of the push-back block 222 is short, it is possible to stop the lever 30 from swinging without contacting the bottom end 351). In addition, because the spacing H between the first and second push-back surfaces 353 and 354 is greater than the thickness of the push-back block 222, when the first push-back surface 353 and the push-back end 351 are both in contact with different sides of the push-back block 222, the second push-back surface 354 is spaced on the surface of the push-back block 222 without contacting the surface of the push-back block 222.

As can also be seen from FIG. 9A, in this embodiment, since the thickness of the push-back block 222 corresponds to the thickness of the push-back end surface 351 and the push-back notch 35 has a tapering pattern S3, when both the first push-back surface 353 and the push-back end surface 351 are in contact with different sides of the push-back block 222, one side of the push-back block 222 pushes against the first push-back surface 353 and the tip will just push back against the push-back end surface 351, which prevents the lever 30 from moving horizontally in the insertion direction. In addition, even if the cam 30 does not fully contact the push-back block 222 during the swinging of the lever 30, the extension direction of the push-back block 222 is at a blunt angle to the insertion direction and the push-back notch 35 is in a tapering pattern S3 so that the lever 30 may be guided by the push-back block 222 and the push-back notch 35 during the swinging of the lever 30 to move towards the push-back block 222.

As can be seen from the above, in this embodiment, the cam-type wire connector 1 comprises two positioning structures that prevent the lever 30 from continuing to rotate after the elastic member (flexible section 212*c*) has been changed into the activation position. The positioning structure comprises a first positioning structure formed by the elastic member (flexible section 212*c*) and the cam 33 and a second positioning structure formed by the push-back block 222 and the push-back notch 35 of the conductive member 22, which prevents the user from mistakenly thinking that the lever 30 has not been pushed into position and continuing to apply force to the lever 30.

In addition, in this embodiment, the lever 30 is prevented from rotating by face contact between the first push-back surface 353 and the push-back block 222. In another embodiment of the present invention, the profile of the cam 33 can be changed to form a second positioning structure by setting a plane with a position and angle corresponding to the first push-back surface 353 in the present embodiment on the cam 33, without the need for a push-back notch 35. Or in other embodiments, the first push-back surface 353 can be aligned with a portion of the surface of the cam 33.

As shown in the figure, in this embodiment, when the lever 30 touches the cover 12 of the housing 10, the push-back block 222 will simultaneously contact the push-back notch 35 and stop swinging relative to the housing 10, and prevent the lever 30 from moving in a straight line parallel to the insertion direction relative to the housing 10. The surface of the cam 33 of the lever 30 in contact with the contact block 221 changes from the second push-back surface 331*c* to the second positioning surface 331*b* so that the fixed surface 331*e* of the cam 33 contacts the flexible section 212*c*, allowing the lever 30 to stay in the actuate position P2 where the leaf spring 21 can be deformed, and the flexible section 212*c* remains in the deformation state A2. And, the flexible section 212*c* remains in a position away from the conductive member 22, forming an insertion channel that allows the wires to enter the window 212*d*.

As can be seen from the figure, in this embodiment, when the lever 30 is in the actuate position P2, the first push-back surface 331*a* of the actuating profile 331 is in contact with the push-back block 222 of the conductor 20, and the second push-back surface 331*c*, the first positioning surface 331*d*, and the touch surface 331*f* of the actuating profile 331 are not in contact with the conductor 20. The second positioning surface 331*b* is in face contact with the conductive member 22, and the fixed surface 331*e* will be in face contact with the second segment 2122*b*, and both the second positioning surface 331*b* and the fixed surface 331*e* are approximately parallel, and the projection position of the fixed surface 331*e* in the vertical direction will be located in the second positioning surface 331*b*; thus, when the second segment 2122*b* acts on the cam 33 (fixed surface 311*e*), the force will be directed toward the second positioning surface 331*b* without generating a torque that can rotate the cam 33 and change the user's feel when operating the lever 30 when the actuate position P2 is reached. The lever 30 may also be returned to the actuate position P2 by the flexible section 212*c* in case of a slight collision with the lever 30 and swinging.

Also, Although the lever 30 is able to move in two dimensions at the initial position P1, it can also be seen from FIG. 9A that, when the lever 30 is in the actuate position P2, the lever 30 is prevented from moving in the vertical direction because the cam 33 is vertically against the second segment 2122*b* and the conductive member 22. The first push-back surface 331*a* of the cam 33 is directed to the right side against the push-back block 222, and push-back block 222 prevents the counterclockwise rotation of the lever 30 against the push-back notch 35 so that the position and rotation angle of the lever 30 are fixed after moving to the actuate position P2, and when the lever 30 leaves the actuate position P2, it must first swing and then move out of the actuate position P2.

In addition, in other embodiments, since the cams 33 are supported on the left and right sides by the push-back block 222 and the first segment 2122*a*, even if the aforementioned second positioning surface 331*b* and the fixed surface 331*e* are not parallel to each other, the lever 30 will not rotate in the actuate position P2 due to the action of the leaf spring 21, even if the force on the fixed surface 331*e* is projected on the second positioning surface 331*b* in the direction of the force.

Figure 10:
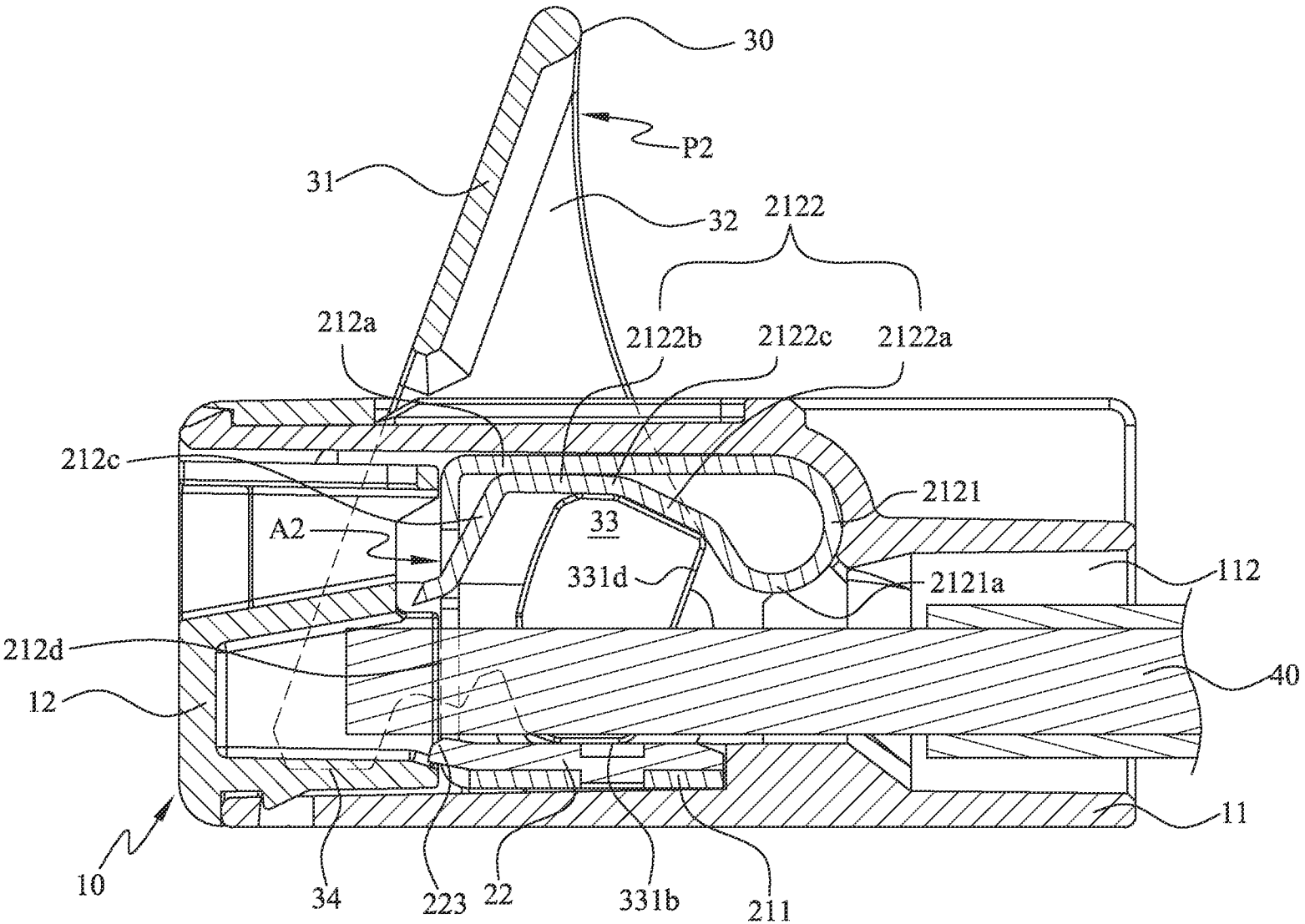
FIG. 10 shows a schematic view of a wire threading into the cam-type wire connector.
Figure 11:
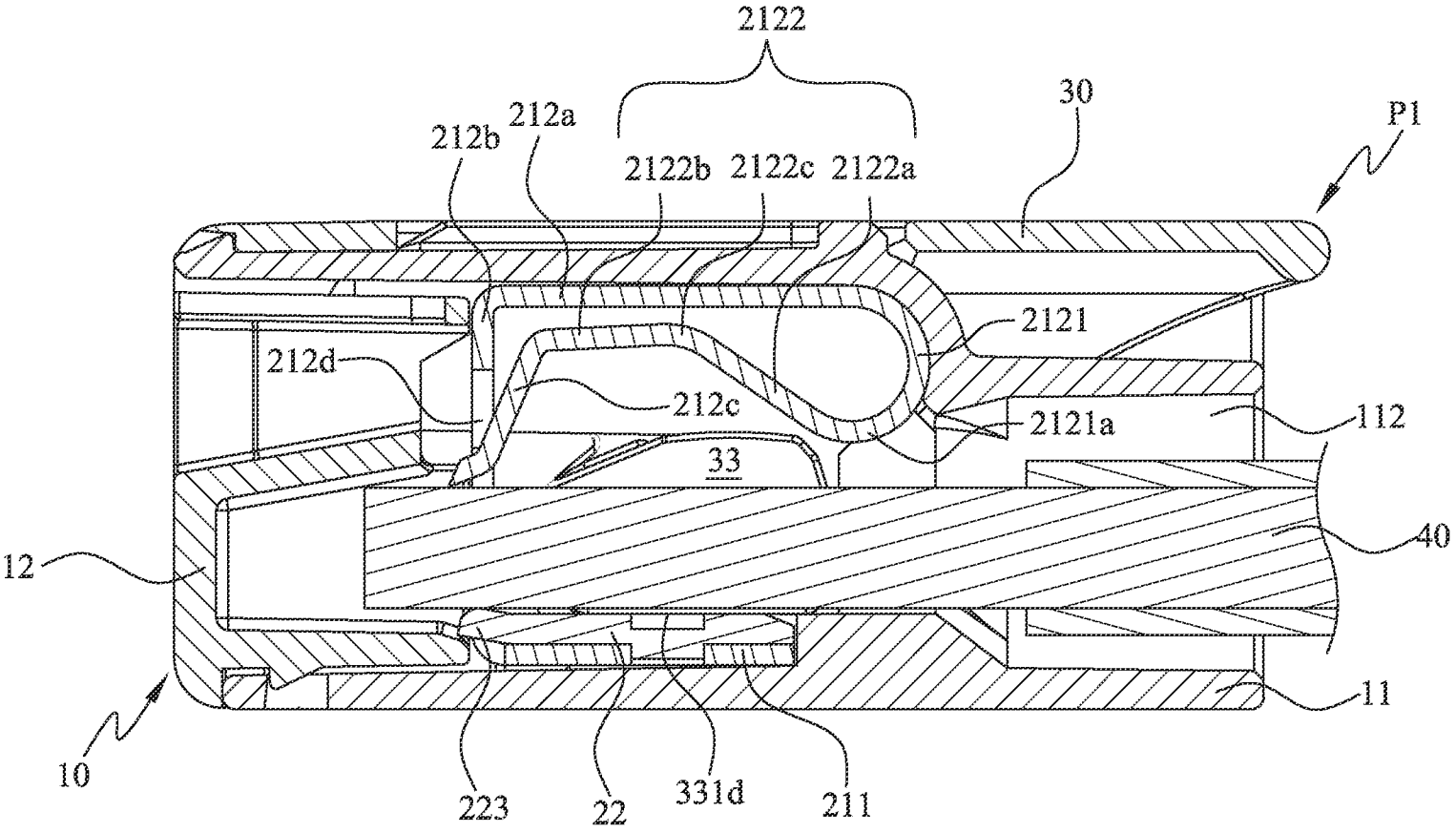
FIG. 11 shows a schematic view of a leaf spring and a conductive member that are clamped together into a wire.

With reference to FIG. 10 and FIG. 11, after the lever 30 is in the actuate position P2, the wire 40 may be threaded through the insertion hole 112 of the housing 10 to the interior of accommodation space 113 of the housing 10. The wire 40 may pass through the flexible section 212*c* of the leaf spring 21 and the guiding block 223 of the conductive member 22, and through the window 212*d* of the leaf spring 21 so that the end of the wire 40 may be close to the cover 12 of the housing 10. Afterwards, during the movement of the lever 30 from the actuate position P2 to the initial position P1, the cam 33 of the lever 30 changes the position of the flexible section 212*c* acting on the leaf spring 21 so that the flexible section 212*c* pushes against the wire 40 close to the conductive member 22, which in turn presses the wire 40 against the contact with the conductive member 22. In this way, the wire 40 may electrically conduct with another wire 40 on another window 212*d* (blocked by the viewing angle) through the conductive member 22. In addition, as can be seen from FIGS. 10 and 11, when the wire 40 enters the window 212*d*, the position of the joint 2121*a* between the back-fold section 2121 and the first segment 2122*a* will be closer to the wire 40 than the extension portion 2122.

Figure 12:
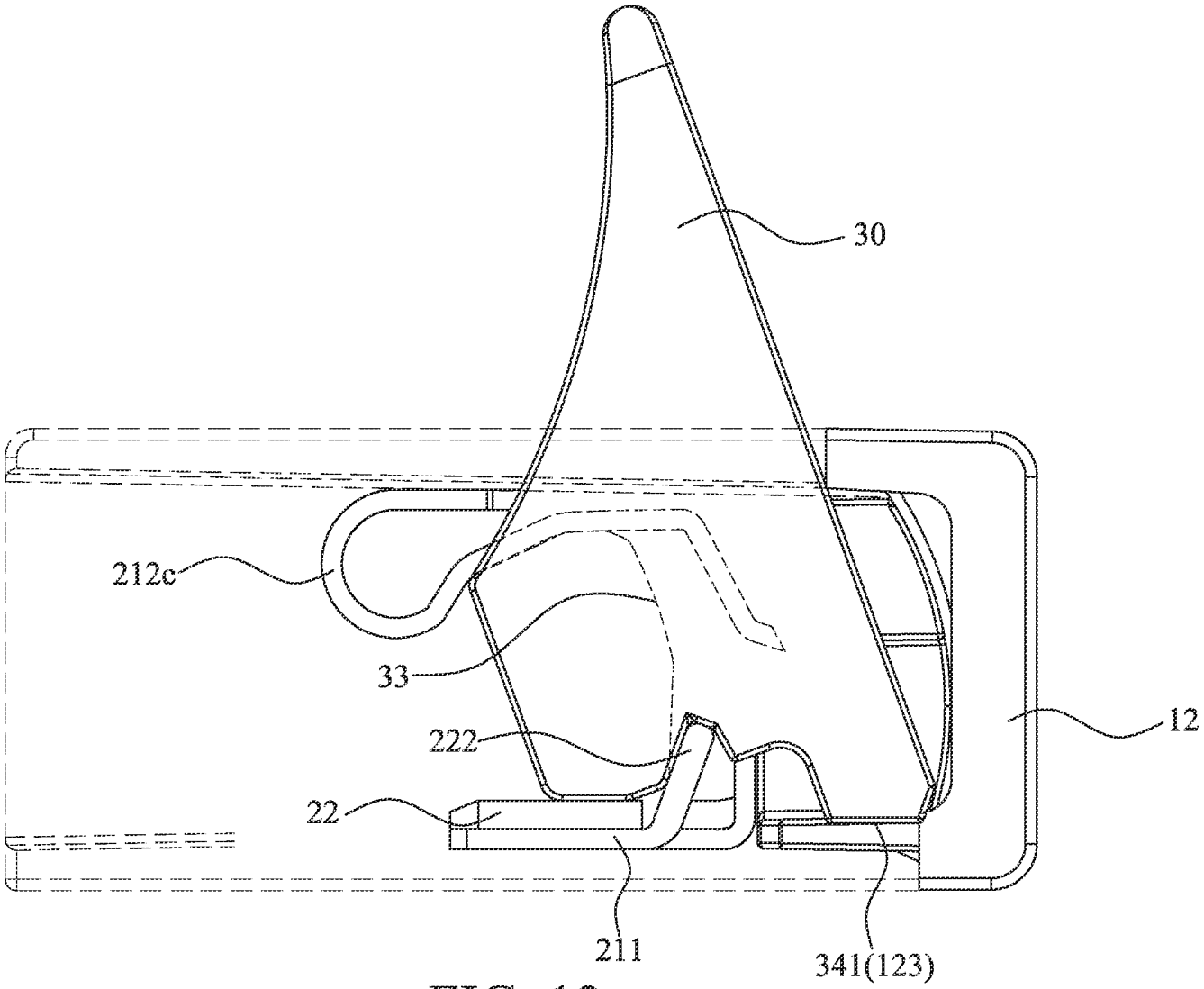
FIG. 12 shows a schematic view of the cam-type wire connector of this invention in a second preferred embodiment.

With reference to FIG. 12, in a second preferred embodiment, the difference from the first preferred embodiment is that the push-back block 222 of the conductive member 22 is formed from the carrier plate 211 of the leaf spring 21 towards the connecting section 212*a* of the leaf spring 21, while both the housing 10 and the lever 30 have the same structural form as the cam-type wire connector 1 of the first preferred embodiment. Furthermore, in this embodiment, it is used in the same manner as in the first preferred embodiment and will not be further described in this embodiment.

What is claimed is:

1. A cam-type wire connector, comprising:

a housing, being formed with a plurality of insertion holes along an insertion direction, and an accommodation space is formed inside the housing for communicating with the insertion holes so that a plurality of wires are inserted into the accommodation space along the insertion holes;

a conductor, being mounted in the accommodation space of the housing and comprising a conductive member forming a plurality of contacts adjacent to each other and a leaf spring pressing the wire against the conductive member, the leaf spring has a carrier plate connected to the conductive member and a wire clamping portion extending from the carrier plate to form a plurality of windows, and a plurality of elastic members is formed with an end of the wire clamping portion that far away from the carrier plate for extending toward the carrier plate;

a plurality of levers, being movably assembled in the housing and having an operating portion that cooperates with the leaf spring and a holding portion for being hold by a user, the contour of the operating portion is formed as a cam so that the operation portion is capable of swinging with a non-fixed axis, and elastic member is capable of being deformed by the cam;

wherein the elastic member blocks the window on the insertion direction when the lever is positioned in an initial position, and the elastic member is moved away from the window by the cam when the lever is positioned in an actuate position; the operating portion has a push-back edge that moves the elastic member and a touch edge that contacts the conductive member, the push-back edge has a fixed surface that contacts the elastic member in the activation position, the touch edge has a first positioning surface that contacts the conductive member in the initial position, a second positioning surface that contacts the conductive member in the actuate position, and a push-back surface between the first positioning surface and the second positioning surface, when the lever is changed from the initial position to the actuate position, the lever contacts the conductive member and pushes the elastic member at the same time so that the elastic member is far away from the carrier plate for forming an insertion channel that allows the wire to enter the window, and the insertion channel is located in the interval between the second positioning surface and the fixed surface.

2. The cam-type wire connector as claimed in claim 1, wherein the elastic member has a depressed area for contacting the push-back edge in the activation position.

3. The cam-type wire connector as claimed in claim 2, wherein the elastic member comprises a back-fold portion, an extension portion that attached to the back-fold portion and extending along the insertion direction, and a covering portion that attached at one end of the extension portion and extending toward the carrier plate for blocking the window in the insertion direction, and the depressed area is formed on the extension portion through two segments that extend in different directions.

4. The cam-type wire connector as claimed in claim 1, wherein a first positioning structure and a second positioning structure are constructed between the conductive member and the lever, the first positioning structure is formed between the elastic member and the cam, and the second positioning structure is formed between the lever and one of the conductive member or the carrier plate.

5. The cam-type wire connector as claimed in claim 4, wherein one of the conductive member or the carrier plate extends a push-back block, and a push-back notch is provided with the lever for cooperating the push-back block to form the second positioning structure, the push-back notch has a first push-back surface that contacts the push-back block.

6. The cam-type wire connector as claimed in claim 1, wherein each of the first positioning surface, the second positioning surface and the fixed surface is formed as a horizontal surface, and the push-back surface is formed as a curve surface.

7. The cam-type wire connector as claimed in claim 1, the touch edge contacts the conductive member and the housing simultaneously in the initial position.

8. The cam-type wire connector as claimed in claim 1, wherein a distance is formed between the fixed surface and the second positioning surface, and the distance is larger than the diameter of the wire.

* * * * *